US006761275B1

(12) United States Patent
McBride et al.

(10) Patent No.: US 6,761,275 B1
(45) Date of Patent: Jul. 13, 2004

(54) DOMED LINER DISC FOR CLOSURE

(75) Inventors: Stephen W. McBride, Brownsburg, IN (US); David Babcock, Carmel, IN (US)

(73) Assignee: Alcoa Closure Systems International, Crawfordsville, IN (US)

( * ) Notice: Subject to any disclaimer, the term of this patent is extended or adjusted under 35 U.S.C. 154(b) by 499 days.

(21) Appl. No.: 09/616,358

(22) Filed: Jul. 14, 2000

(51) Int. Cl.[7] ..... B65D 53/00
(52) U.S. Cl. ..... 215/349; 220/221
(58) Field of Search ..... 215/316–364, 215/270–272, 233, 234, 237, 347; 220/240, 213, 216, 217, 221, 222, 225, 226, 234, 304, 378

(56) References Cited

U.S. PATENT DOCUMENTS 3,061,130 A * 10/1962 Husum ..... 215/347
4,640,428 A * 2/1987 Chang ..... 215/270
4,658,976 A 4/1987 Pohlenz
5,103,990 A 4/1992 Irwin
5,356,021 A 10/1994 McBride et al.
5,433,331 A * 7/1995 Morini ..... 217/271
5,884,788 A 3/1999 Wilde

FOREIGN PATENT DOCUMENTS

DE 26 41 54 3/1977
WO WO 94/29186 12/1994

* cited by examiner

*Primary Examiner*—Lee Young
*Assistant Examiner*—Lien Ngo
(74) *Attorney, Agent, or Firm*—Rockey Milnamow & Katz LTD; Edward L. Levine

(57) ABSTRACT

A liner disc for a bottle cap for sealingly closing a bottle includes an annular rim portion and a downwardly domed portion depending from the annular rim portion. The domed portion is convex toward the contents of the bottle. A seal layer is provided on the domed portion. Internal pressure of the contents of the bottle acts in a direction tending to flatten the domed portion which in turn expands an annular side wall of the domed portion outwardly to press the seal layer against the inside surface of the bottle to assist in effecting a seal between the bottle and the cap.

13 Claims, 3 Drawing Sheets

DOMED LINER DISC FOR CLOSURE

TECHNICAL FIELD

The present invention relates to closures for containers, such as bottle caps for closing bottle necks. The invention particularly relates to a liner disc held within a bottle cap outer shell which is sealingly pressed against a mouth forming part or "finish" of the bottle neck, the cap outer shell having an inside thread engaged with an outside thread of the bottle neck. The liner disc includes a central downwardly domed portion with a liner seal layer applied to outside and underside surfaces of the liner disc. The central domed portion of the liner disc reacts to gas pressure held within the container to press the seal layer against an inside surface of the bottle finish to enhance the seal formed therewith.

BACKGROUND OF THE INVENTION

In conventional bottle closures, a cap-shaped outer shell is threaded onto a bottle neck. A provision is made within the outer shell to seal the outer shell to the finish of the bottle neck. In some designs, such as disclosed in U.S. Pat. Nos. 4,658,976 and 5,356,021, the outer shell holds therein a liner disc which is held by the outer shell tightly against a top surface of the bottle finish.

Such closures for bottle necks are frequently employed to contain a gas pressurized liquid such as a carbonated soft drink. In the case of generally planar liner discs, experience has shown that pressure within the bottle can tend to bow the liner disc and an end wall of the outer shell outwardly, possibly opening the seal around the top surface of the bottle finish. Therefore, special designs and configurations must be employed to maintain the seal under such pressure.

It is also known to provide a liner disc within a bottle closure which has an outer shell with removable panels, removal of which creates evidence that the bottle closure has been previously unscrewed. Such an arrangement is disclosed for example in PCT published application WO94/29186, and U.S. Pat. No. 5,884,788, both hereby incorporated by reference. In this disclosed configuration, however, the liner disc is also a substantially planar member. Pressure from within the container would tend to oppose the sealing pressure of the liner disc against the bottle finish.

It would be desirable to provide a liner disc for a bottle closure which resists outward (upward) bowing under internal gas pressure, and which beneficially increases the sealing effect between the liner disc and the bottle finish due to the gas pressure.

SUMMARY OF THE INVENTION

The invention contemplates a closure cap for a bottle or other container which has a liner disc within a closure outer shell. The liner disc has a surrounding annular rim and a central, downwardly domed portion. The domed portion has an underside covered by a liner sealing material. The central domed portion of the liner disc extends in a direction into the bottle and provides increased resistance to upward doming of the liner disc under influence of internal bottle pressure. The domed central region provides an outward radial force under the influence of internal bottle pressure, to press the sealing material to an inside surface or finish of the bottle neck to enhance the sealing effect of the liner disc with the bottle neck.

Extending downwardly from the surrounding annular rim, the central domed portion is formed with an annular side wall and a contiguous convex bottom wall (convex downwardly). The annular side wall is coaxially arranged with the inside surface of the bottle neck. The annular side wall has an outside surface substantially parallel all around its circumference to an inside surface of the bottle neck.

Applied onto the convex bottom wall and onto the annular side wall is a layer of liner sealing material. Alternatively, the liner sealing material can be applied only on the annular side wall. The liner sealing material can be composed of a softer, or more resilient plastic material than the plastic of the liner disc for scaling the liner disc to the inside surface of the bottle neck.

When the closure is applied onto the bottle, the bottle neck fits between the closure outer shell and the annular side wall. The convex bottom wall fits inside the bottle neck and can radially expand under bottle pressure to press the annular side wall against an inside surface of the bottle neck. The liner sealing material on the annular side wall effects a seal between the annular side wall and the bottle neck.

The closure cap can include a tamper evidence system. The surrounding annular rim of the liner disc can include a formation thereon facing toward an end wall of the outer shell. The formation is configured to coact with tamper evidence panels on the end wall such that differential or relative rotation between the outer shell and the liner disc during closure removal causes breakage or separation of the tamper evidence panels on the outer shell. The breakage or separation of the tamper evidence panels gives the consumer a visual indication that the closure cap had been previously unscrewed or loosened from the bottle neck.

Numerous other advantages and features of the present invention will become readily apparent from the following detailed description of the invention and embodiments thereof, from the claims, and from the accompanying drawings in which the details are fully and completely disclosed as part of the specification.

DETAIL DESCRIPTION OF THE PREFERRED EMBODIMENTS

Figure 1:
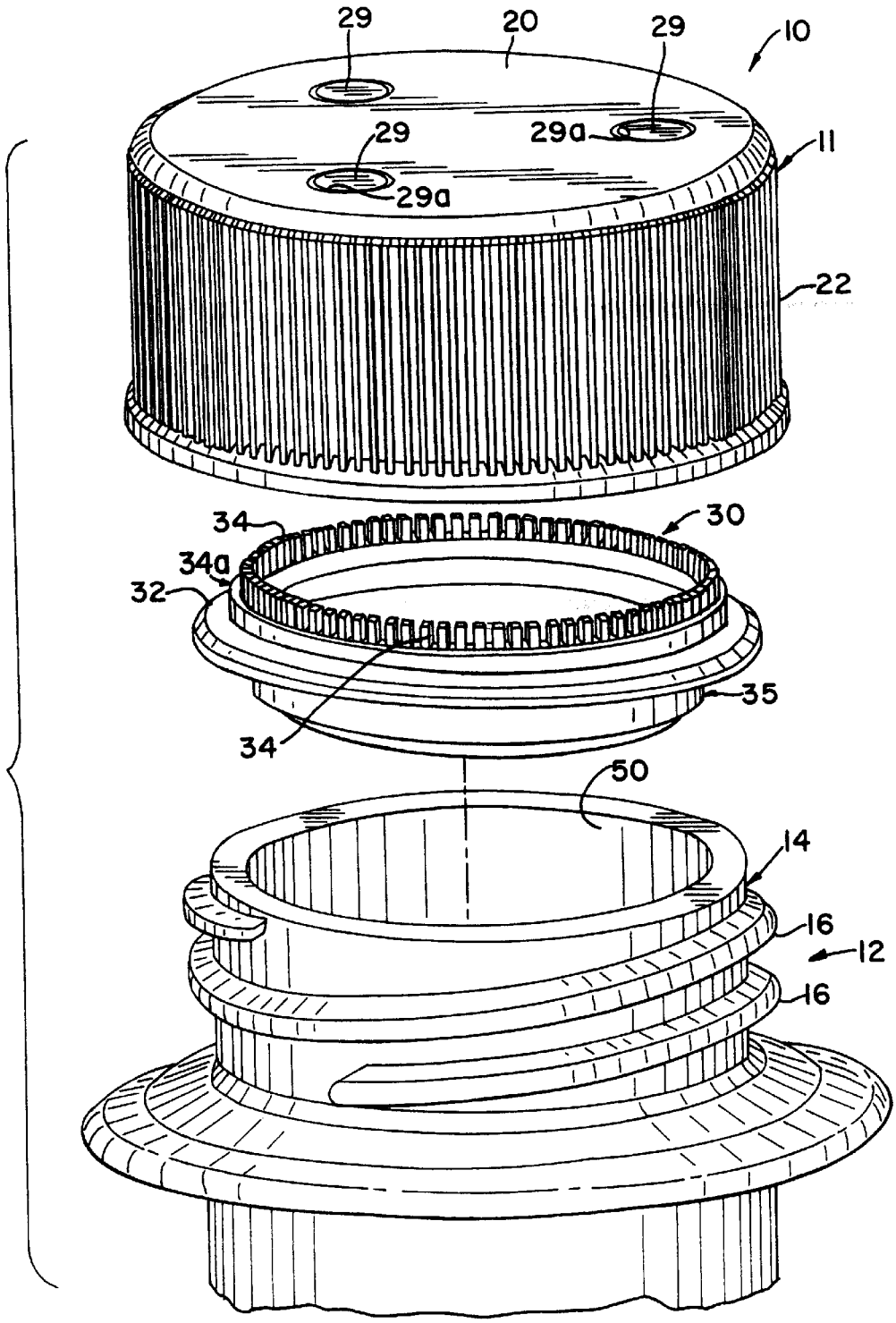
FIG. 1 is a fragmentary exploded perspective view of a bottle and closure cap, including a liner disc, of the present invention.

While this invention is susceptible of embodiment in many different forms, there is shown in the drawings and will be described herein in detail, specific embodiments thereof with the understanding that the present disclosure is to be considered an exemplification of the principles of the invention and is not intended to limit the invention to the specific embodiments illustrated.

FIG. 1 illustrates a closure cap 10 for closing a bottle 12. The bottle 12 includes a bottle neck portion 14 having external threads 16 for engagement with the closure cap.

The closure cap 10 includes a cap outer shell 11 having an end wall 20 and a depending side wall 22 having internal threads 24 (shown in FIG. 2) for engagement with the external threads 16 on the bottle neck portion 14. The end wall 20 includes removable panels 29 which provides tamper evidence as described below.

Figure 1A:
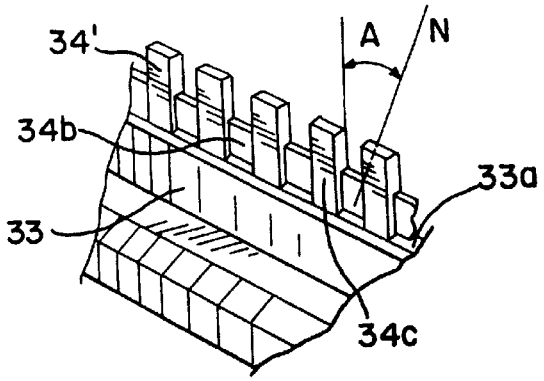
FIG. 1A is a fragmentary, enlarged perspective view of a portion of an alternate liner disc.

Arranged between the cap outer shell 11 and the bottle neck portion 14 is a liner disc 30 of the present invention. The liner disc 30 includes an annular rim 32 with a raised annular ridge 33 having upstanding teeth 34, and a downwardly domed portion 35 depending from and closing the annular rim. The upstanding teeth 34 can extend perpendicularly from the annular ridge 33 as shown in FIG. 1, or can be inclined obliquely around the circumference of the ridge as shown in FIG. 1A, as inclined teeth 34'. The inclined teeth 34' are set at an angle A from a normal line N perpendicular to a top surface 33*a* of the ridge 33. An outside surface of the teeth 34' is indicated at 34*c*. The inclined teeth 34' can also be reinforced by intermediate walls 34*b* formed integrally with the teeth 34' and the top surface 33*a* of the ridge 33. It is believed that the inclined teeth may be more effective for some applications.

Figure 2:
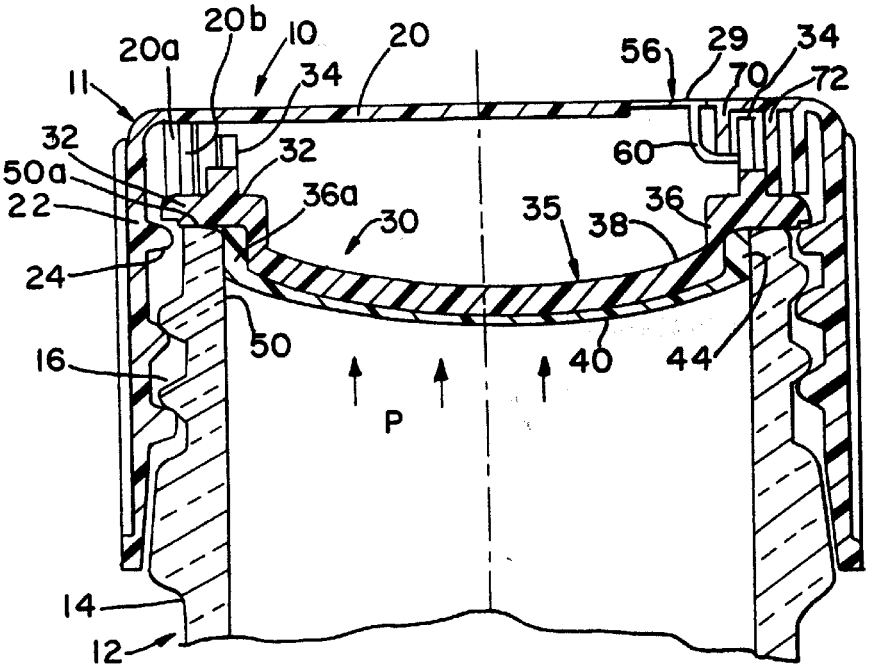
FIG. 2 is a cross-sectional view of a bottle with a closure cap of the present invention applied thereto.

FIG. 2 illustrates the closure cap 10 installed onto the bottle 12 in accordance with the present invention. The cap end wall 20 includes downwardly extending annular members 20*a*, 20*b* which press the rim 32 of the liner disc 30 onto a top surface 50*a* of the bottle finish. The domed portion 35 includes an annular side wall 36 and a convex portion in the form of a bottom wall 38, which extends convexly into the bottle. The annular side wall has an outside surface 36*a* which is substantially parallel all around its circumference to an inside surface 50 of the bottle neck. A seal layer 40 of polymer material is applied onto a surface of the bottom wall 38 and up and onto the annular side wall 36 forming an annular seal layer 44. The annular seal layer 44 is sized to be compressed against the inside surface of the finish 50 of the bottle neck to effect a seal thereto when the cap 10 is installed onto the bottle.

Advantageously, the liner disc 30 is composed of polypropylene and the seal layer 40 is composed of a polymer liner material such as KRATON or SANTOPRENE.

The domed portion 35 extends downwardly into the bottle. Gas pressure P inside the bottle tends to deflect a central region of the convex portion 38 upwardly which causes a radial outward force on the annular side wall 36 to further press the annular seal layer 44 against the bottle.

As illustrated in FIGS. 1 and 2, the end wall 20 includes a tamper evidence feature 56. Perimeter-weakened panels 29 are connected to a tab 60 which is engaged by the teeth 34 of the liner disc. The perimeter-weakened panels can be defined by a perimeter 29*a* of a lesser thickness than the remaining end wall 20, or by scoring or perforating the respective perimeters 29*a*. Differential rotary movement between the end wall 28 and the liner disc 30 acts to tear away the perimeter-weakened panels 29 when the closure cap 10 is unscrewed from the bottle 12.

Plural cams 70, 72 are arranged on the end wall 20 toward the teeth 34 for straddling the teeth and assisting in the engagement of the tab 60 with the teeth for forcibly displacing the perimeter-weakened panels 29.

Figure 3:
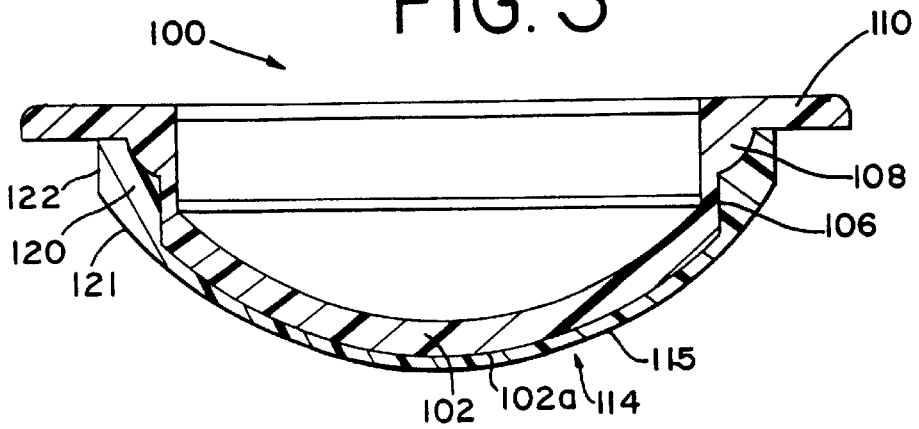
FIG. 3 is a longitudinal sectional view of another alternate liner disc of the present invention.

FIG. 3 illustrates an alternate embodiment wherein a liner disc 100 has a downwardly domed bottom wall 102 which has a more pronounced or deeper semispherical shape (e.g., having a smaller radius of curvature) than the wall 38 shown in FIG. 2. The depth or radius of curvature of the downwardly domed bottom wall 102 can be adjusted to optimize the sealing effect of the disc liner against the bottle finish. An annular side wall 106, contiguous with the bottom wall 102, includes a thickened shoulder 108 which is contiguous with an annular rim 110. A seal layer 114 is applied onto the bottom wall 102, the annular side wall 106, and the thickened shoulder 108, to the annular rim 110. The seal layer is relatively thin in a bottom layer 115, over the bottom wall 102, and relatively thick in an annular seal layer 120, over the annular side wall 106. The annular seal layer 120 includes a first surface portion 121 having a contour with a parallel curvature to a convex surface 102*a* of the bottom wall 102, and a second surface portion 122 being generally parallel to an inside surface of the bottle finish, i.e., coaxially aligned. The annular seal layer 120, when the closure is installed onto a bottle, will be pressed into the inside bottle finish 50 by initial compression during installation, and also by internal bottle pressure acting on the bottom wall 102 as described above.

Figure 4:
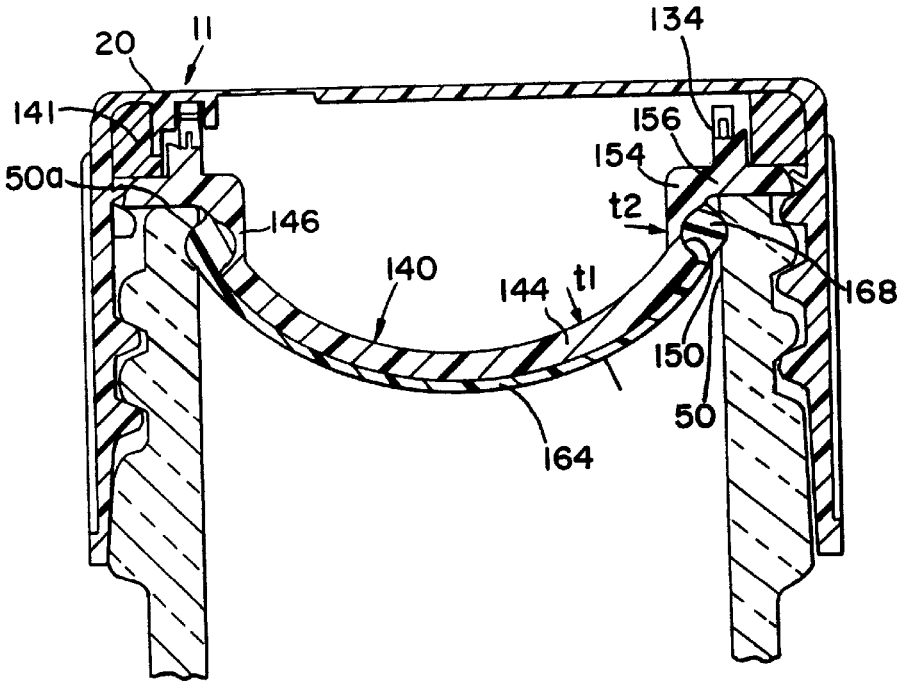
FIG. 4 is a longitudinal sectional view of a further alternate liner disc of the present invention in use with a closure outer shell, applied to a bottle.

FIG. 4 illustrates another embodiment of the invention. A liner disc 140 is pressed to the top surface 50*a* of the bottle finish by an annular ring 141 pressed by the end wall 20 of the outer shell 11. The liner disc 140 includes a convex bottom wall 144 having a thickness t1 and an annular side wall 146 having a relatively reduced thickness t2 due to an annular groove 150. The annular sidewall 146 extends continuously into a thickened shoulder 154 which extends into an annular rim 156. Tamper evidence teeth 134 can extend upwardly from the rim 156 and function as described for the teeth 34 of the first embodiment.

A seal layer 164 is applied onto the bottom wall 144 and onto the side wall 146, into the groove 150. An O-ring portion 168 of the seal layer is formed extending out of the groove 150. For simplicity, the O-ring portion 168 is shown in a non-compressed, relaxed state. Once installed, the O-ring portion 168 would be flattened and squeezed by the bottle finish 50.

Figure 5:
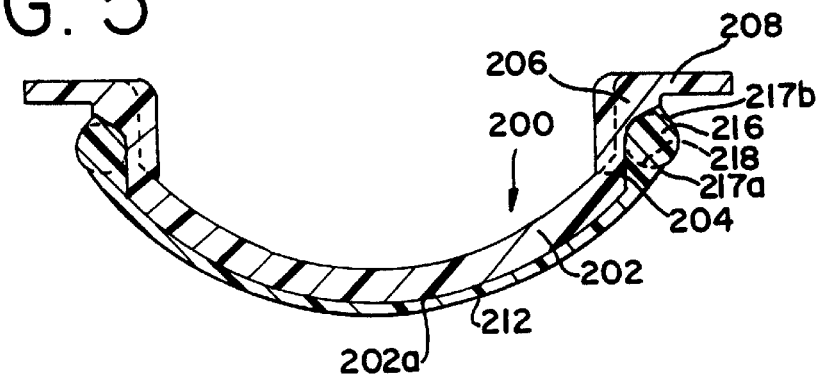
FIG. 5 is a sectional view of another alternate embodiment liner disc of the present invention.

FIG. 5 illustrates another embodiment liner disc 200 having a bottom wall 202 and an annular side wall 204 of similar thickness as the bottom wall. The side wall 204 extends continuously into a shoulder 206 which extends into an annular rim 208. A seal layer 212 is applied onto a convex bottom surface 202*a* of the bottom wall 202 and is thickened around the annular side wall 204 to create a seal ring portion 216. The seal ring portion 216 includes a first surface portion 217*a* which has a parallel curvature to the convex bottom surface 202*a* of the bottom wall 202, and a second surface portion 217*b* which has a smaller radius of curvature than the first surface portion and which diverges radially inwardly. A theoretical O-ring profile 218 is shown dashed within the seal ring portion 216.

Figure 6:
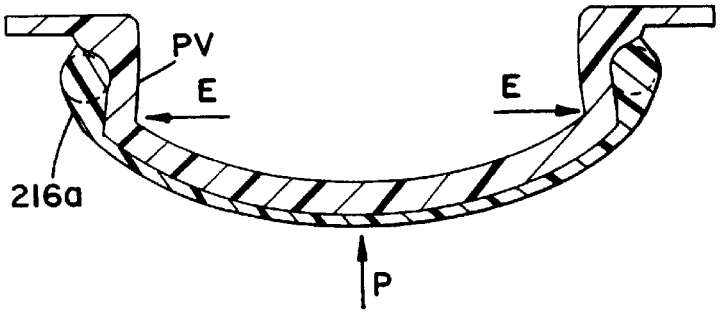
FIG. 6 is a sectional view of the liner disc of FIG. 5 demonstrating its deformation under internal bottle pressure.

FIG. 6 demonstrates the action of the liner disc 200 under internal bottle pressure. Internal pressure P causes seal expansion E in the radial direction. An expected pivot location PV of the side wall will cause more of a lower portion 216*a* of the seal ring portion 216 to engage the bottle inside surface. More seal pressure and greater contact area ensures a better seal under the influence of internal bottle pressure.

From the foregoing, it will be observed that numerous variations and modifications may be effected without departing from the spirit and scope of the invention. It is to be understood that no limitations with respect to the specific apparatus illustrated herein is intended or should be inferred.

It is, of course, intended to cover by the appended claims all such modifications as fall within the scope of the claims.

What is claimed is:

1. For a closure having threads for engaging a container, and closing an opening of the container defined by a container wall, a separate liner disc comprising:

an annular seal portion including an annular side wall having an outside surface substantially parallel all around its circumference to an inside surface of said container wall for radially pressing said inside surface of the container wall to seal thereto;

a convex portion closing said annular seal portion and exposed to pressure from within the container, said convex portion extending in a direction into the container and including a convex surface facing into the container; and a sealing layer applied to said outside surface of said annular side wall and to said convex surface of said convex portion continuously, said sealing layer forming a relatively thick annular seal layer covering said annular side wall and a relatively thin bottom layer covering said convex portion.

2. The liner disc according to claim 1, wherein said annular seal layer comprises an O-ring shape.

3. The liner disc according to claim 1, wherein said annular seal layer includes a first outer surface portion having a contour substantially parallel to said convex surface of said convex portion, and a contiguous second outer surface portion substantially parallel to said inside surface of said container wall.

4. The liner disc according to claim 1, wherein said annular seal layer includes a first surface portion having a contour substantially parallel to a curvature of said convex surface of said convex portion, and a second surface portion contiguous with said first surface portion and which diverges radially inwardly with a smaller radius of curvature from said first surface portion.

5. A closure for a bottle neck, comprising:

a cap outer shell having at least one inside retaining element for engagement to the exterior of the bottle neck, the cap outer shell having an end wall and a depending annular side wall;

a liner disc having an annular rim arranged to be pressed to an end of the bottle neck by the end wall, a contiguous annular region arranged for sealing in a radial direction against an inside surface of the bottle neck and having an outside surface, and a contiguous region closing the annular region and facing in a direction away from said end wall and into the bottle neck; and a seal layer applied continuously to said annular region and said contiguous region of said liner disc for sealing against the inside surface of the bottle neck, said seal layer including a relatively thick annular seal layer covering said annular region and a relatively thin bottom layer covering said continuous region.

6. The closure according to claim 5 wherein said annular region comprises an annular side wall having an outside surface substantially parallel to an axis of the bottle neck.

7. The closure according to claim 5 wherein said seal layer is composed of a polymer material being softer than said liner disc.

8. The closure according to claim 5 wherein said contiguous region is convex shaped.

9. For a closure having threads for engaging a container, and closing an opening of the container defined by a container wall, a liner disc comprising:

an annular seal portion for radially pressing an inside surface of the container wall to seal thereto; and a convex portion closing said annular seal portion and exposed to pressure from within the container, said convex portion extending in a direction into the container, wherein said annular seal portion includes an annular side wall having an outside surface facing said inside surface of said container wall, and said convex portion includes a convex surface facing into the container, and the disc includes a sealing layer applied to said outside surface of said annular side wall and to said convex surface of said convex portion continuously, said sealing layer forming an annular seal layer covering said annular side wall, wherein said annular side wall includes an annular groove for holding said annular seal layer partially therein, said annular seal layer comprising an O-ring profile.

10. A closure assembly for engaging a container, and closing an opening of the container defined by a container wall, said closure assembly comprising:

a closure element having an annular rim arranged to be pressed against an end of said container wall and a depending annular seal portion for radially pressing an inside surface of the container wall to seal thereagainst, said annular seal portion including an annular side wall having an outside surface facing said inside surface of said container wall, said closure clement including a lower surface positioned inwardly of said outside surface and facing into said container; and a sealing layer applied continuously to said outside surface of said annular side wall and to said lower surface of said closure element, said sealing layer forming an annular seal layer covering said annular side wall, said annular seal layer comprising an O-ring shape, said annular side wall including an annular groove for holding said annular seal layer partially therein, said annular seal layer comprising an O-ring profile.

11. A closure assembly in accordance with claim 10, wherein:

said closure assembly includes an internally threaded skirt portion for retaining said closure assembly on said container.

12. A closure assembly in accordance with claim 10, wherein:

said closure assembly includes an annular skirt having at least one inside retaining element for engagement with the exterior of said container wall.

13. A closure assembly in accordance with claim 10, wherein:

said lower surface of said closure element is positioned at the lower extent of said outside surface of said closure element and is downwardly convex.

* * * * *